US005921307A

United States Patent [19]

Ford et al.

[11] Patent Number: 5,921,307

[45] Date of Patent: Jul. 13, 1999

[54] GARAGE DOOR HINGE

[75] Inventors: Jim S. Ford; Loren D. Mock, both of Lawrence, Kans.

[73] Assignee: Garage Door Group, Inc., Lawrence, Kans.

[21] Appl. No.: 08/982,271

[22] Filed: Dec. 1, 1997

[51] Int. Cl.[6] ..... E05D 15/10

[52] U.S. Cl. ..... 160/229.1; 160/201

[58] Field of Search ..... 160/201, 229.1, 160/232, 40, 199, 206; 16/97, 104, 223

[56] References Cited

U.S. PATENT DOCUMENTS

| | | | |
|---|---|---|---|
| 126,464 | 5/1872 | Kohler . | |
| 1,626,844 | 5/1927 | Kuhn . | |
| 2,233,351 | 2/1941 | Rowe | 16/97 |
| 2,263,995 | 11/1941 | Katulski | 160/201 X |
| 2,300,265 | 10/1942 | Siess . | |
| 2,331,340 | 10/1943 | Mosher . | |
| 2,557,716 | 6/1951 | Allee . | |
| 2,831,537 | 4/1958 | Ritter . | |
| 2,951,533 | 9/1960 | Lucas et al. . | |
| 2,952,313 | 9/1960 | Stroup . | |
| 3,000,048 | 9/1961 | Harsch . | |
| 3,302,690 | 2/1967 | Hurd . | |
| 3,319,697 | 5/1967 | Krohn . | |
| 3,608,613 | 9/1971 | Halliwell | 160/201 X |
| 3,891,021 | 6/1975 | Geoffrey . | |
| 3,894,571 | 7/1975 | Hinchliff . | |
| 3,941,180 | 3/1976 | Thill . | |
| 3,967,671 | 7/1976 | Stanley et al. . | |
| 4,119,133 | 10/1978 | Wolf . | |
| 4,269,253 | 5/1981 | Ziegler . | |
| 4,290,233 | 9/1981 | Hubbard . | |
| 4,379,480 | 4/1983 | Kempel et al. . | |
| 4,436,136 | 3/1984 | Downey, Jr. . | |
| 4,518,026 | 5/1985 | Otto et al. . | |
| 4,644,725 | 2/1987 | Schijf . | |
| 4,718,472 | 1/1988 | Hormann . | |
| 4,736,785 | 4/1988 | Seuster . | |
| 4,854,365 | 8/1989 | Juneau . | |
| 4,893,666 | 1/1990 | Hormann . | |
| 4,924,932 | 5/1990 | Esnault . | |
| 4,989,660 | 2/1991 | Wagner . | |
| 5,002,114 | 3/1991 | Hormann . | |
| 5,016,700 | 5/1991 | Wenger et al. . | |
| 5,042,556 | 8/1991 | Ruiter . | |
| 5,133,108 | 7/1992 | Esnault . | |
| 5,148,850 | 9/1992 | Urbanick . | |
| 5,163,493 | 11/1992 | Kraeutler . | |
| 5,170,832 | 12/1992 | Wagner . | |
| 5,235,724 | 8/1993 | Perrin et al. | 160/201 X |
| 5,359,812 | 11/1994 | Mayfield . | |
| 5,365,993 | 11/1994 | Jella . | |
| 5,394,924 | 3/1995 | Rejc . | |
| 5,396,735 | 3/1995 | Dietrich . | |
| 5,495,640 | 3/1996 | Mullet et al. . | |
| 5,522,446 | 6/1996 | Mullett et al. . | |
| 5,562,141 | 10/1996 | Mullett et al. . | |
| 5,564,164 | 10/1996 | Jella . | |
| 5,566,740 | 10/1996 | Mullett et al. . | |
| 5,622,012 | 4/1997 | Schijf . | |
| 5,626,176 | 5/1997 | Lewis, Jr. et al. . | |
| 5,630,459 | 5/1997 | Martin . | |
| 5,669,431 | 9/1997 | Druzynski et al. | 160/229.1 |
| 5,782,283 | 7/1998 | Kendall . | |

*Primary Examiner*—David M. Purol
*Attorney, Agent, or Firm*—Hovey, Williams, Timmons & Collins

[57] ABSTRACT

A segmented door (10) such as a garage door includes a plurality of adjacent door panels (12, 14) pivotally interconnected for movement between a pivoted position and an alignment position. The edge walls (30, 34) on opposed sides of the juncture (26) between adjacent panels (12, 14) present mated, arcuate surfaces. The preferred door (10) includes a hinge bracket (38) mounted to one panel (12) and a hinge brace (40) mounted to an adjacent panel (14) configured to present hinge pin holes (66, 74) in registration with a hinge pin (42) received therein, adjacent the first panel (12) and spaced from the juncture (26) between the panels (12, 14). The bracket (38) and brace (40) are configured for gradually closing the gap between the edge walls (30, 34) and so that the edge walls (30, 34) slide by one another to prevent pinching in the juncture (26) during movement from the pivoted to the aligned position.

20 Claims, 2 Drawing Sheets

GARAGE DOOR HINGE

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the invention

The present invention is concerned with the field of segmented doors such as garage doors. More particularly, the invention is concerned with such a door having a hinge bracket mounted to one panel and a hinge brace mounted to an adjacent panel configured to present hinge pin holes in registration and having a hinge pin received therein and spaced from the juncture between the panels. The bracket and brace are configured for gradually closing the gap between the edge walls so that the edge walls slide by one another to prevent pinching in the juncture during movement from the pivoted to the aligned position.

2. Description of the Prior Art

Segmented doors, such as multi-panel garage doors, have presented a hazard in that the juncture between adjacent panels presents a pinching hazard as the doors close and the panels shift to an aligned position. Prior art attempts to solve this problem have met with only limited success, sometimes presenting mechanical complexity or uneconomical designs, for example.

SUMMARY OF THE INVENTION

The present invention solves the prior art problems mentioned above and provides a distinct advance in the state of the art. In particular, the segmented door hereof is mechanically simple and economical to manufacture and install.

The preferred segmented door includes a plurality of adjacent door panels, a hinge bracket mounted to one panel, a hinge brace mounted to an adjacent panel, and a hinge pin received in respective, registered, hinge pin holes defined in the bracket and brace. The adjacent panels present mated, arcuate edge walls. The bracket and brace are configured to position the hinge pin adjacent the one panel and spaced from the juncture so that the gap between the edge walls closes gradually and so that the edge walls slide by one another during movement from the pivoted position to the aligned position.

In preferred forms, the door panels present interior faces spaced from respective exterior faces with the hinge pin positioned therebetween. Other preferred aspects of the present invention are disclosed herein.

DETAILED DESCRIPTION OF THE PREFERRED EMBODIMENT

Figure 2:
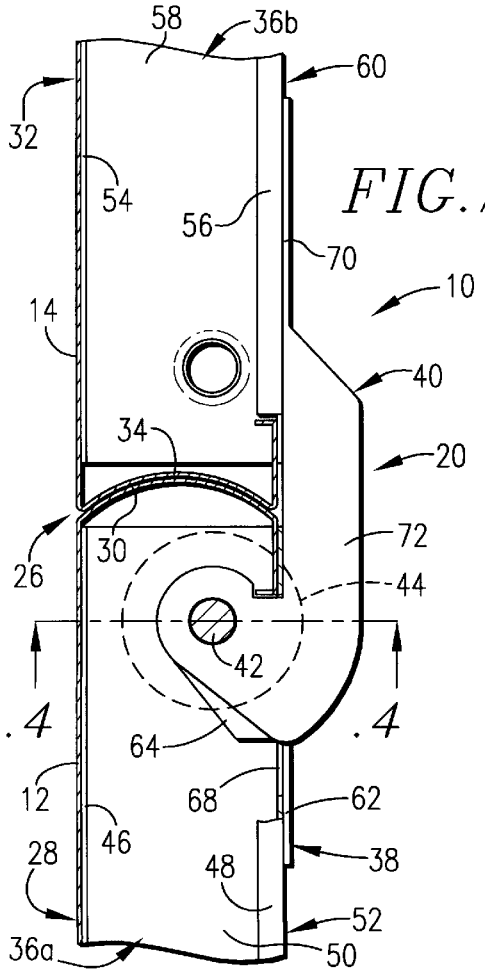
FIG. 2 is a partial, side elevational view in partial section of the preferred segmented door in accordance with the present invention showing adjacent door panels in the aligned position.
Figure 3:
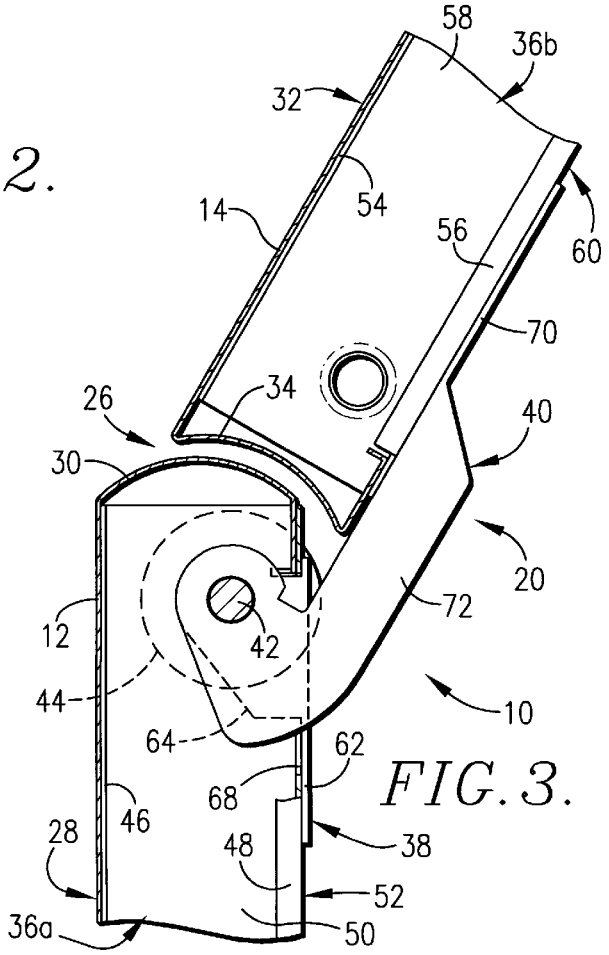
FIG. 3 is a view similar to FIG. 2 but showing the panels in the pivoted position.
Figures 5, 6:
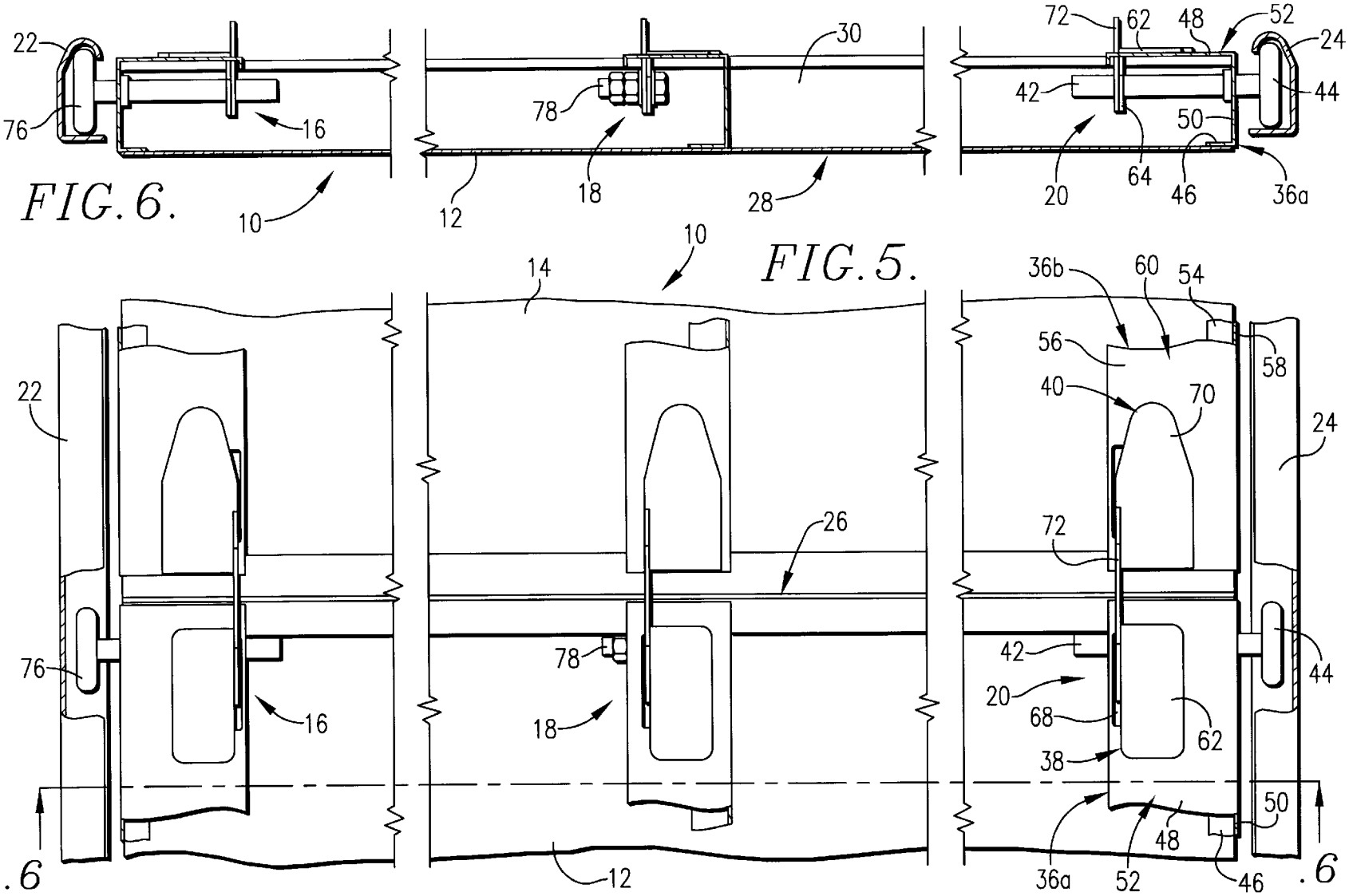
FIG. 5 is a rear elevational view of the door of FIG. 2.
FIG. 6 is a sectional view taken along line 6—6 of FIG. 5.

Turning initially to FIGS. 2, 3 and 6, preferred segmented door 10 in accordance with the present invention includes a plurality of adjacent door panels such as first panel 12 and second panel 14 along with a plurality of hinge assemblies including left assembly 16, center assembly 18 and right assembly 20. Door 10 is guided and supported by left guide track 22 and right guide track 24.

As best viewed in FIGS. 2 and 3, adjacent, first and second panels 12,14 present juncture 26 therebetween. First panel 12 presents exterior face 28 and includes arcuate edge wall 30 preferably in the form of a convex radius. Similarly, second panel 14 presents exterior face 32 and includes arcuate, edge wall 34, preferably in the form of a concave radius configured to mate with and engage convex edge wall 30 as illustrated in FIG. 2. With this design, panels 12 and 14 present a coped joint adding structural strength to door 10 when the panels are aligned and providing a generally tighter joint, less subject to infiltration.

Figure 4:
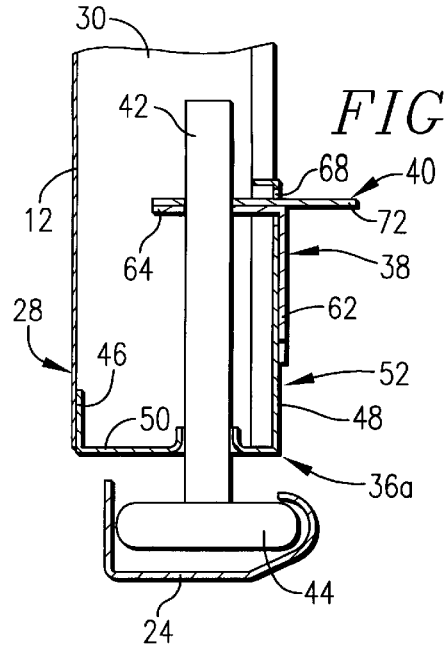
FIG. 4 is a partial sectional view taken along line 4—4 of FIG. 2.
Figure 1:
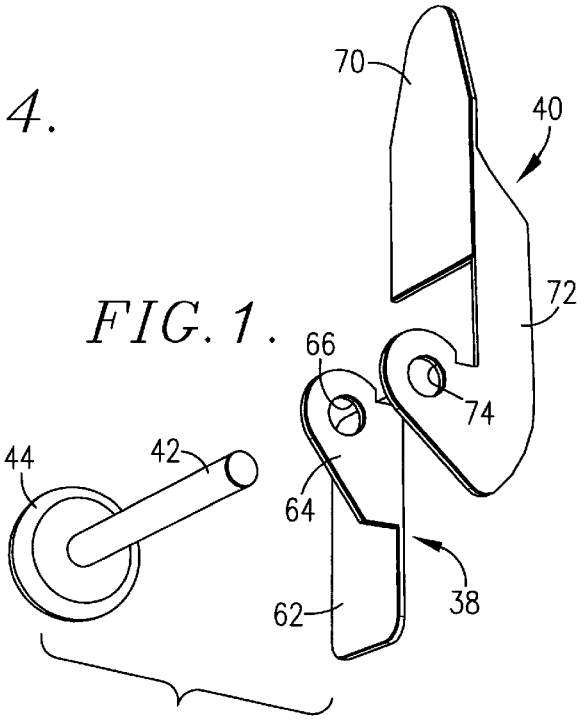
FIG. 1 is an exploded view of the preferred hinge assembly in accordance with the present invention.

Right hinge assembly 20 includes lower mounting channel 36*a*, upper mounting channel 36*b*, hinge bracket 38, hinge brace 40 and hinge pin 42 in the form of a guide roller axle with guide roller 44 attached to one end thereof as illustrated in FIG. 1, for example. Lower mounting channel 36*a* includes short flange 46 attached to the inboard surface of first panel 12, long flange 48 and web 50 therebetween. Long flange 48 presents interior face 52. Similarly, upper mounting channel 36*b* includes short flange 54 attached to the inboard surface of second panel 14, long flange 56 and web 58 therebetween. Long flange 56 presents interior face 60. As best viewed in FIGS. 2, 3 and 5, channels 36*a,b* are positioned on opposed sides of juncture 26 and configured so that interior faces 52 and 60 are substantially contiguous when panels 12 and 14 are in the aligned position.

As best viewed in FIG. 1, metal hinge bracket 38 includes mounting shoe 62 and integral hinge leg 64 extending transversely therefrom with first hinge pin hole 66 defined therethrough. Bolts, sheet metal screws or rivets mount shoe 62 to interior face 52 of mounting channel 36*a* with hinge leg 64 extending through slot 68 in order to position first hole 66 between interior face 52 and exterior face 28.

Metal hinge brace 40 includes mounting plate 70 and integral J-shaped hinge arm 72 with second hinge pin hole 74 defined therethrough adjacent the distal end thereof. Bolts, sheet metal screws or rivets attach mounting plate 70 to interior face 60 so that hinge arm 72 spans juncture 26 and so that second hole 74 registers with first hole 66.

The hinge arm 72 is substantially perpendicular to the mounting plate 70, and the hinge leg 64 is substantially perpendicular to the mounting shoe 62. The hinge leg 64 and hinge arm 72 are also substantially perpendicular to the interior face 52. Both the hinge arm 72 and the hinge leg 64 extend, parallel to each other, through the slot 68 provided on the interior face 52 of the channel 36*a*. Thus, the holes 66, 74 and the hinge pin 42 are held inside the panel, that is inside the channel 36*a* which forms part of the panel. Further, the hinge pin is closer to the lower panel than to the upper panel.

Hinge pin 42 is received through holes 66 and 74 and pivotally couples panels 12 and 14 as illustrated in FIGS. 2 and 3. Guide roller 44 is received in right guide track 24.

Left hinge assembly 16 is the same as right hinge assembly 20 except that left-right reversed and having guide roller 76 received in left guide track 22 as shown in FIGS. 5 and 6. Center hinge assembly 18 is also the same as right hinge assembly 20 except that the hinge pin is in the form of bolt 78. A plurality of hinge pin assemblies are provided for each juncture between adjacent panels of door 10.

It will be appreciated that some door panels include an inboard wall and an outboard wall with a space therebetween which may be hollow, or filled with insulation or other filler. In these circumstances, the inboard wall presents an interior face and mounting channels are not needed. That is, the hinge brackets and hinge braces are mounted to the interior face of the inboard wall in order to position the hinge pin between the interior and exterior faces and spaced from the juncture.

In operation, FIG. 3 illustrates door panels 12 and 14 in the pivoted position with panel 14 at an angle relative to panel 12. This represents the position of the door panels during opening and closing of door 10.

As door 10 closes, panel 14 pivots about hinge pin 42 toward the aligned position illustrated in FIG. 12 in which both panels are substantially in the same plane. As panel 14 pivots toward the aligned position, the gap between edge walls 30 and 34 gradually closes as walls 30, 34 slide by one another. Any object present in juncture 26 is pushed outwardly because of the relative sliding action between walls 30 and 34. In this way, juncture 26 does s not present a pinching hazard, which has been a problem in the prior art.

Those skilled in the art will appreciate that the present invention encompasses many variations in the preferred embodiment described herein. For example, the preferred door can include any desired number of panels with hinge assemblies spaced as needed at the junctures between adjacent panels. Moreover, the invention encompasses variations in the structure of the hinge assemblies and in the edge walls of adjacent panels so that the pinching hazard is eliminated. Having thus described the preferred embodiment of the present invention, the following is claimed as new and desired to be secured by Letters Patent:

We claim:

1. A segmented door comprising:

a plurality of adjacent door panels including adjacent first and second panels with a juncture therebetween and having respective, mated edge walls on opposed sides of said juncture, said panels each presenting an exterior face;

a hinge bracket mounted to said first panel and having a first hinge pin hole therein adjacent said first panel;

a hinge brace mounted to said second panel and having a second hinge pin hole therein positioned adjacent said first panel and in registration with said first hole; and a hinge pin received in said pin holes and pivotally coupling said first and second panels for movement between a pivoted position and an aligned position, said hinge pin being positioned inside said first panel, spaced inboard of said exterior face, and spaced from and parallel to said juncture so that said edge walls slide by one another during said movement and matingly engage in said aligned position.

2. The door as set forth in claim 1, said first edge wall presenting a convex radius, said second edge wall presenting a concave radius.

3. The door as set forth in claim 1, said first and second panels having respective interior faces spaced from said exterior faces, said hinge pin being positioned between said interior and exterior faces of said first panel.

4. The door as set forth in claim 3, said hinge bracket including a mounting shoe attached to said interior face of said first panel, and a hinge leg transverse thereto with said first hinge pin hole defined therein.

5. The door as set forth in claim 4, said hinge brace including a mounting plate attached to said interior face of said second panel and a hinge arm extending from said mounting plate, spanning said juncture, and presenting said second hinge pin hole adjacent the distal end thereof.

6. The door as set forth in claim 1, said hinge pin including a roller axle.

7. The door as set forth in claim 1, said hinge pin including a bolt.

8. The door as set forth in claim 1, said bracket and brace being configured for gradually closing the gap between said edge walls and so that said edge walls slide by one another in order to prevent pinching in said juncture during movement from said pivoted position to said aligned position.

9. The door as set forth in claim 1 including a plurality of said brackets, braces and pins spaced along the junctures between adjacent ones of said panels.

10. The door as set forth in claim 1, one of said edge walls presenting a convex radius and the other of said walls presenting a concave radius, said first and second panels having respective interior faces spaced from said exterior faces, said hinge pin being positioned between said interior and exterior faces of said first panel, said hinge bracket including a mounting shoe attached to said interior face of said first panel, and a hinge leg transverse thereto with said first hinge pin hole defined therein, said hinge brace including an mounting plate attached to said interior face of said second panel and a hinge arm extending from said mounting plate, spanning said juncture, and presenting said second hinge pin hole adjacent the distal end thereof, and said bracket and brace being configured for gradually closing the gap between said edge walls and so that said edge walls slide by one another in order to prevent pinching in said juncture during movement from said pivoted position to said aligned position.

11. The door as set forth in claim 5, said hinge arm comprising a generally J-shaped hinge arm.

12. A segmented door comprising:

a plurality of adjacent door panels including adjacent first and second panels with a juncture therebetween and having respective mated edge walls on opposed sides of said juncture, said panels each presenting an exterior face;

a hinge bracket mounted to said first panel and having a mounting shoe and a hinge leg with a first hinge pin hole therein adjacent said first panel, and said hinge leg being substantially perpendicular to said mounting shoe and extending toward said exterior face;

a hinge brace mounted to said second panel and having a mounting plate and a hinge arm with a second hinge pin hole therein positioned adjacent said first panel and in registration with said first hole, and said hinge arm being substantially perpendicular to said mounting plate and extending toward said exterior face;

a hinge pin received in said pin holes and pivotally coupling said first and second panels for movement between a pivoted position and an aligned position; and said hinge pin being positioned adjacent said first panel, spaced inboard of said exterior face, and spaced from and parallel to said juncture.

13. The door as set forth in claim 12, said hinge leg being substantially parallel to said hinge arm.

14. The door as set forth in claim 12, said hinge leg and said hinge arm extending into said first panel.

15. The door as set forth in claim 12, said first panel having an interior face spaced from the exterior face of the first panel.

16. The door as set forth in claim 15, said hinge leg and said hinge arm are substantially perpendicular to said interior face.

17. The door as set forth in claim 15, said interior face defining a slot, and said hinge leg and said hinge arm extending through said slot.

18. The door as set forth in claim 15, said first panel including a channel, and said interior surface being provided on said channel.

19. A segmented door comprising:

a plurality of adjacent door panels including adjacent first and second panels with a juncture therebetween and having respective mated edge walls on opposed sides of said juncture, said panels each presenting an exterior face and an interior face spaced apart from said exterior face;

a hinge bracket mounted to said first panel and having a mounting shoe and a hinge leg with a first hinge pin hole therein adjacent said first panel, and said hinge leg being substantially perpendicular to said interior face and extending toward said exterior face;

a hinge brace mounted to said second panel and having a mounting plate and a hinge arm with a second hinge pin hole therein positioned adjacent said first panel and in registration with said first hole, and said hinge arm being substantially perpendicular to said interior face and extending toward said exterior face;

a hinge pin received in said pin holes and pivotally coupling said first and second panels for movement between a pivoted position and an aligned position; and said hinge pin being positioned adjacent said first panel, spaced inboard of said exterior face, and spaced from and parallel to said juncture.

20. The door as set forth in claim 19, said first panel including a channel and said interior surface being provided on said channel.

* * * * *